US010124585B2

(12) United States Patent
Masuda et al.

(10) Patent No.: US 10,124,585 B2
(45) Date of Patent: Nov. 13, 2018

(54) LIQUID DISCHARGE HEAD, LIQUID DISCHARGE DEVICE, AND LIQUID DISCHARGE APPARATUS

(71) Applicants: Toshiaki Masuda, Kanagawa (JP); Keisuke Hayashi, Kanagawa (JP); Keishi Miwa, Kanagawa (JP)

(72) Inventors: Toshiaki Masuda, Kanagawa (JP); Keisuke Hayashi, Kanagawa (JP); Keishi Miwa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/268,711

(22) Filed: Sep. 19, 2016

(65) Prior Publication Data

US 2017/0100934 A1 Apr. 13, 2017

(30) Foreign Application Priority Data

Oct. 7, 2015 (JP) ..... 2015-199790

(51) Int. Cl.
*B41J 2/14* (2006.01)
*B41J 2/16* (2006.01)

(52) U.S. Cl.
CPC ..... *B41J 2/14233* (2013.01); *B41J 2/1623* (2013.01); *B41J 2002/14241* (2013.01); *B41J 2002/14306* (2013.01)

(58) Field of Classification Search
CPC ..... B41J 2002/14241
See application file for complete search history.

(56) References Cited

U.S. PATENT DOCUMENTS

2003/0025754 A1* 2/2003 Mou ..... B41J 2/14024 347/20
2003/0063137 A1* 4/2003 Kamei ..... B41J 2/161 346/70
2003/0222944 A1* 12/2003 Matsuzawa ..... B41J 2/14233 347/68

(Continued)

FOREIGN PATENT DOCUMENTS

JP 10-119263 5/1998
JP 10-119270 5/1998

(Continued)

*Primary Examiner* — Shelby Fidler
(74) *Attorney, Agent, or Firm* — Cooper & Dunham LLP

(57) ABSTRACT

A liquid discharge head includes an actuator substrate and a holding substrate. The actuator substrate includes a plurality of individual liquid chambers and a plurality of pressure generating elements. The plurality of individual liquid chambers is communicated with a plurality of nozzles to discharge liquid. The plurality of pressure generating elements is arrayed to pressurize liquid in the plurality of individual liquid chambers. The holding substrate includes a plurality of recessed portions to accommodate the plurality of pressure generating elements. The holding substrate is bonded to the actuator substrate with an adhesive. The holding substrate has a plurality of openings as a plurality of channels communicating the plurality of individual liquid chambers with a common liquid chamber to supply liquid to the plurality of individual liquid chambers. At least one corner of each of the plurality of openings at least partially has a curved surface.

9 Claims, 17 Drawing Sheets

(56) References Cited

U.S. PATENT DOCUMENTS

| | | | | |
|---|---|---|---|---|
| 2010/0079546 | A1* | 4/2010 | Takahashi | B41J 2/161 347/45 |
| 2011/0018943 | A1* | 1/2011 | Owaki | B41J 2/14233 347/54 |
| 2011/0298872 | A1 | 12/2011 | Hayashi | |
| 2012/0069101 | A1* | 3/2012 | Kato | B41J 2/14233 347/70 |
| 2012/0182356 | A1 | 7/2012 | Hayashi et al. | |
| 2013/0155159 | A1 | 6/2013 | Kinokuni et al. | |
| 2013/0182040 | A1 | 7/2013 | Kinokuni et al. | |
| 2013/0241990 | A1 | 9/2013 | Shimoda et al. | |
| 2013/0242004 | A1 | 9/2013 | Hayashi | |
| 2013/0242012 | A1 | 9/2013 | Hayashi et al. | |
| 2013/0307911 | A1 | 11/2013 | Hayashi | |
| 2014/0267497 | A1 | 9/2014 | Takagi et al. | |
| 2015/0097898 | A1 | 4/2015 | Hayashi | |
| 2015/0314600 | A1* | 11/2015 | Donning | B41J 2/14024 347/44 |
| 2016/0001556 | A1 | 1/2016 | Masuda et al. | |
| 2016/0023465 | A1 | 1/2016 | Hayashi | |
| 2016/0121610 | A1* | 5/2016 | Ashikaga | B41J 2/14233 347/70 |
| 2017/0001441 | A1* | 1/2017 | Kato | B41J 2/14201 |

FOREIGN PATENT DOCUMENTS

| | | |
|---|---|---|
| JP | 2007-045017 | 2/2007 |
| JP | 2010-201781 | 9/2010 |
| JP | 2013-058568 | 3/2013 |
| JP | 2013-163341 | 8/2013 |

* cited by examiner

FIG. 17

| OPENING WIDTH [um] | R [um] | OUTFLOW |
|---|---|---|
| 250 | 125 | ABSENT |
| | 60 | ABSENT |
| | 40 | PRESENT |
| 200 | 100 | ABSENT |
| | 20 | PRESENT |
| 160 | 80 | ABSENT |
| | 20 | PRESENT |

FIG. 18

| OPENING WIDTH | R | STEP OF OPENING | OUTFLOW |
|---|---|---|---|
| 250 | 125 | PRESENT | ABSENT |
| | 100 | ABSENT | ABSENT |
| | 40 | PRESENT | ABSENT |
| | 40 | ABSENT | PRESENT |
| | 20 | PRESENT | PRESENT |
| | 20 | ABSENT | PRESENT |

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2015-199790 filed on Oct. 7, 2015 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head may include, for example, a holding substrate (also referred to as protective substrate) bonded on an actuator substrate with adhesive. The holding substrate covers a plurality of pressure generating elements arrayed on the actuator substrate. The holding substrate includes openings as channels communicating a common liquid chamber with individual liquid chambers of the actuator substrate.

SUMMARY

In an aspect of the present disclosure, there is provided a liquid discharge head that includes an actuator substrate and a holding substrate. The actuator substrate includes a plurality of individual liquid chambers and a plurality of pressure generating elements. The plurality of individual liquid chambers is communicated with a plurality of nozzles to discharge liquid. The plurality of pressure generating elements is arrayed to pressurize liquid in the plurality of individual liquid chambers. The holding substrate includes a plurality of recessed portions to accommodate the plurality of pressure generating elements. The holding substrate is bonded to the actuator substrate with an adhesive. The holding substrate has a plurality of openings as a plurality of channels communicating the plurality of individual liquid chambers with a common liquid chamber to supply liquid to the plurality of individual liquid chambers. At least one corner of each of the plurality of openings at least partially has a curved surface.

In another aspect of the present disclosure, there is provided a liquid discharge device that includes the liquid discharge head to discharge liquid.

In still another aspect of the present disclosure, there is provided a liquid discharge apparatus that includes the liquid discharge device to discharge liquid.

In still yet another aspect of the present disclosure, there is provided a liquid discharge apparatus that includes the liquid discharge head to discharge liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 17 is a table of evaluation results of curved surfaces of corners of the opening;

FIG. 18 is a table of evaluation results of curved surfaces of corners of the opening;

Figure 1:
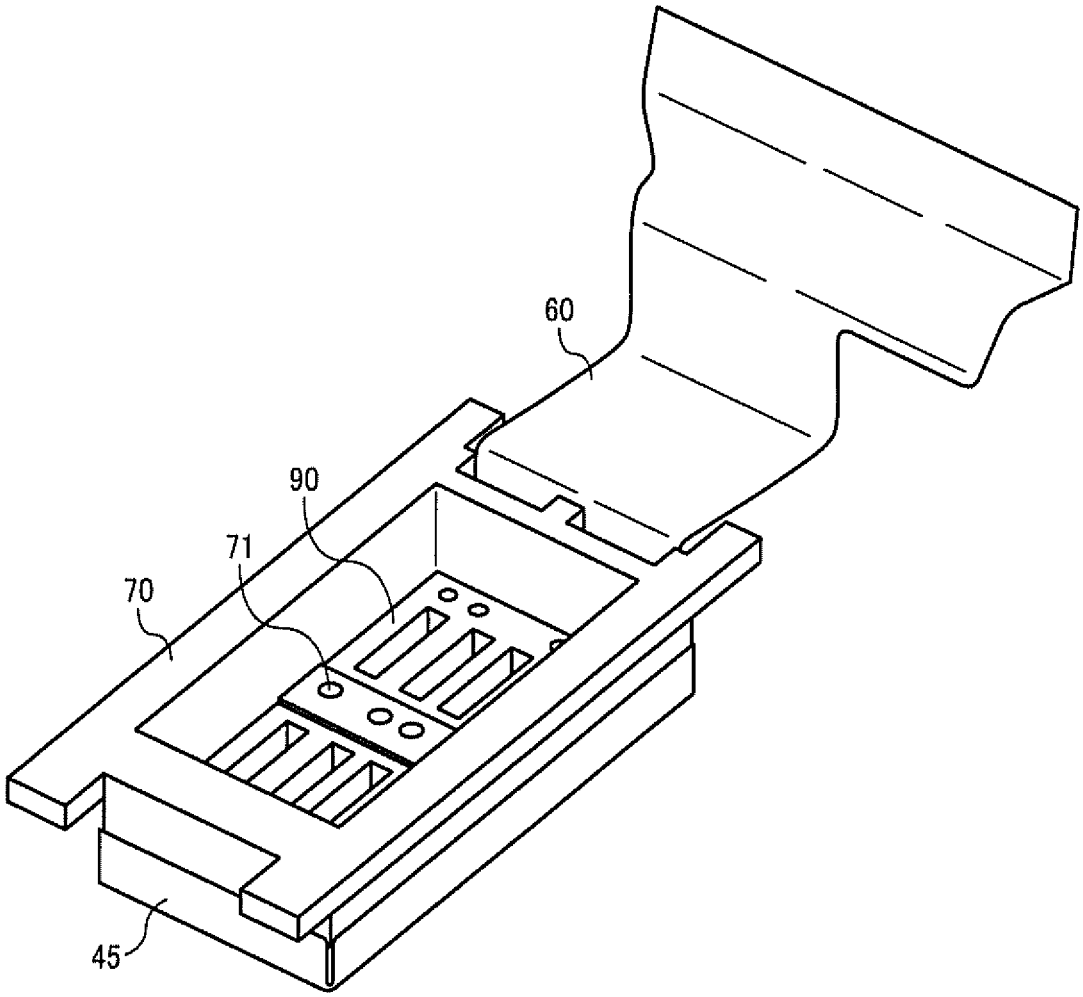
FIG. 1 is a perspective view of an example of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
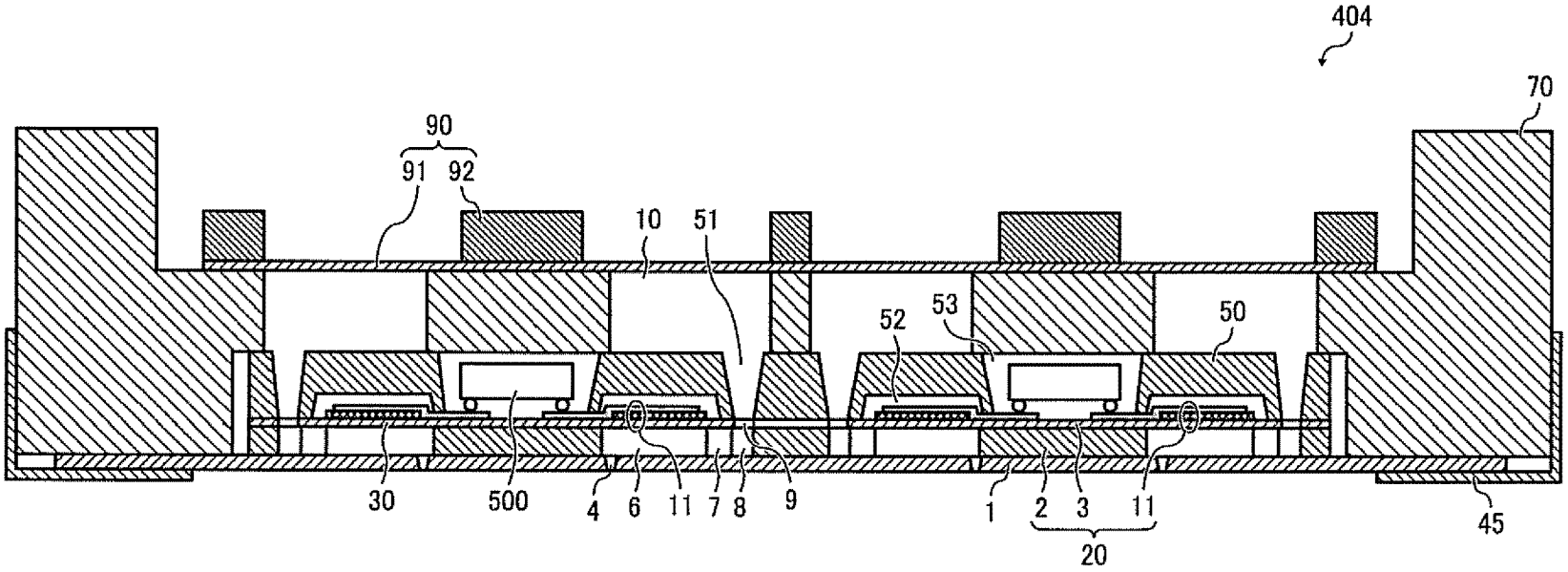
FIG. 2 is a cross-sectional view of a portion of the liquid discharge head of FIG. 1 cut along a direction perpendicular to a nozzle array direction in which nozzles are arrayed in row.
Figure 3:
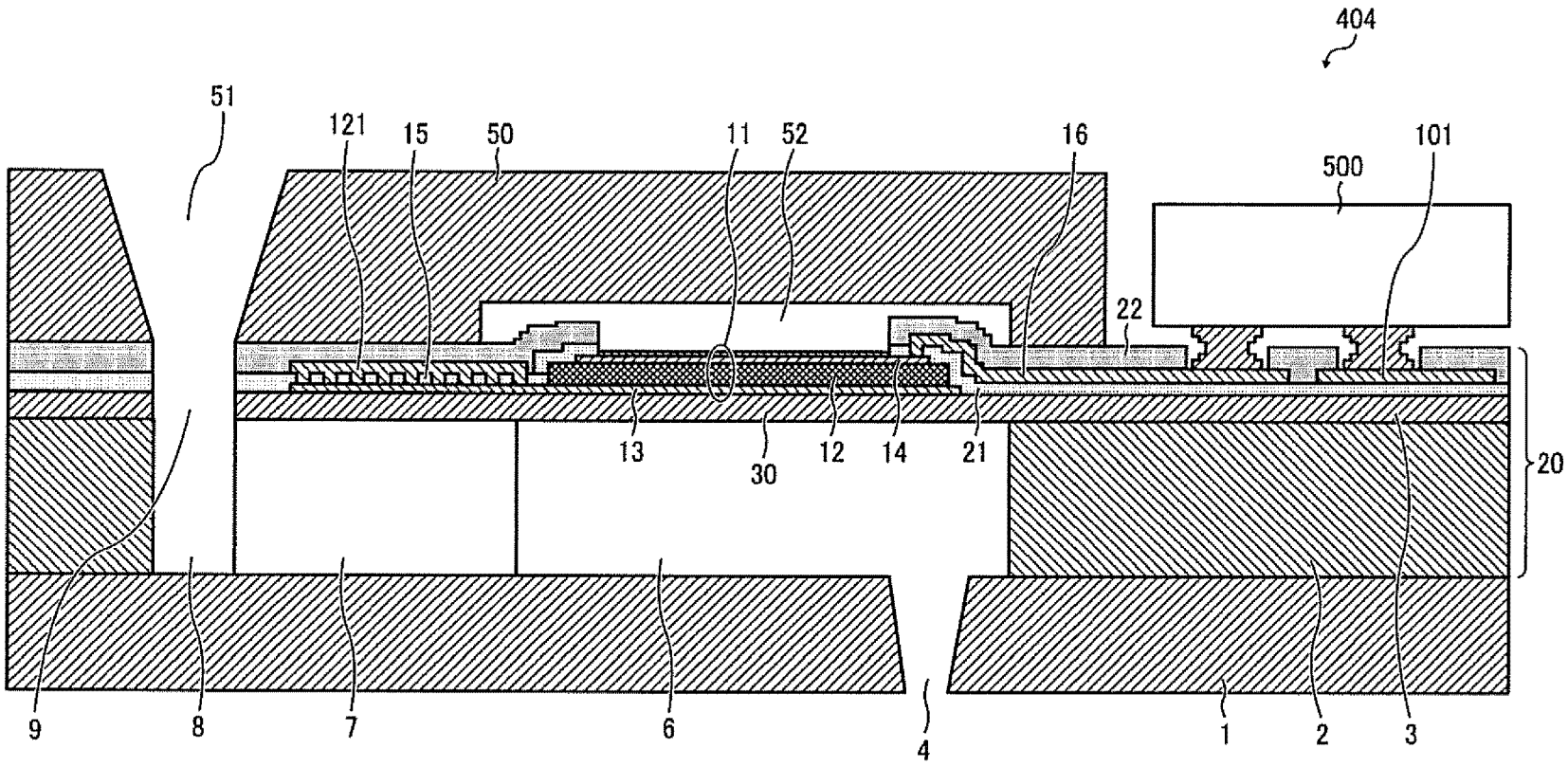
FIG. 3 is an enlarged cross-sectional view of a portion of the liquid discharge head of FIG. 2.
Figure 4:
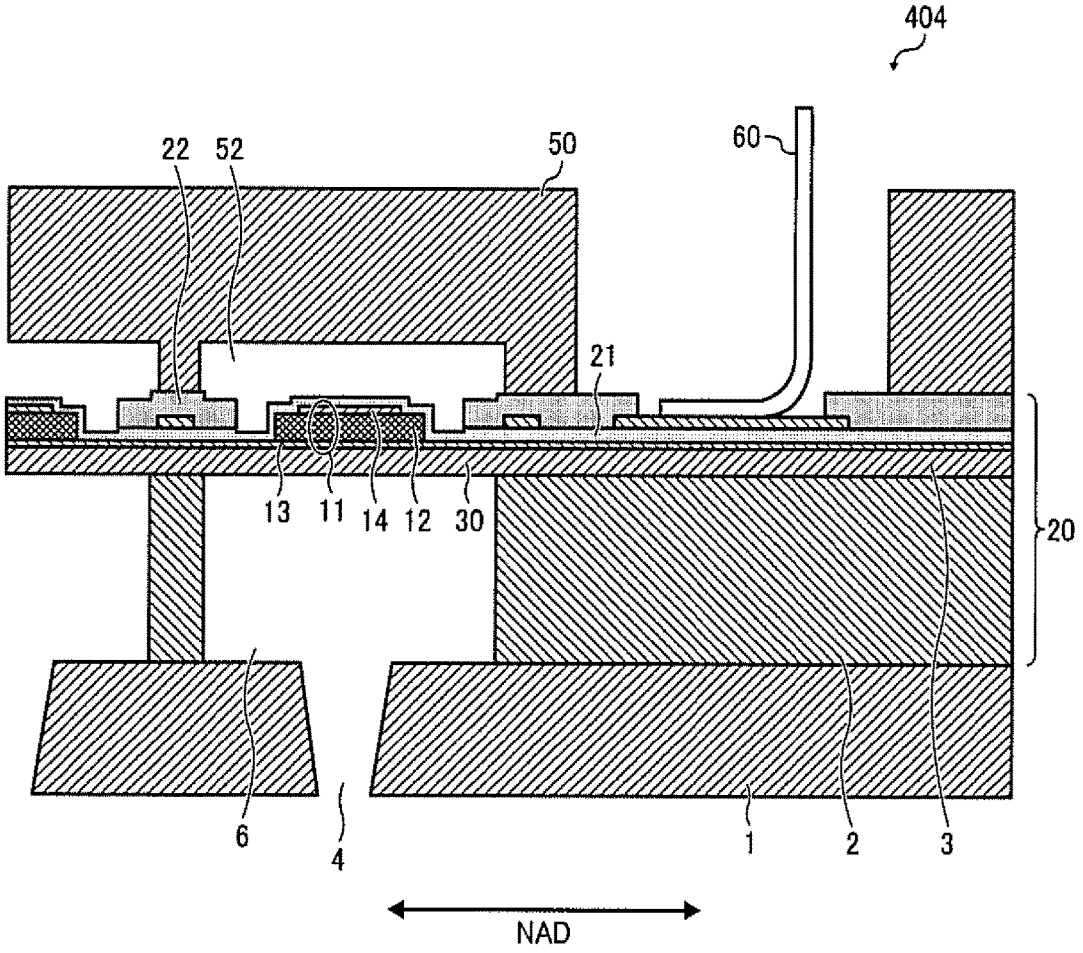
FIG. 4 is a cross-sectional view of a portion of the liquid discharge head of FIG. 2 cut along the nozzle array direction.

Referring now to the drawings, wherein like reference numerals designate identical or corresponding parts throughout the several views, exemplary embodiments of the present disclosure are described below. A liquid discharge head according to an embodiment of the present disclosure is described with reference to FIGS. 1 to 4. FIG. 1 is an exploded perspective view of the liquid discharge head according to an embodiment of the present disclosure. FIG. 2 is a cross-sectional view of the liquid discharge head of FIG. 1 cut along a direction perpendicular to a nozzle array direction in which nozzles are arrayed in row. FIG. 3 is an enlarged cross-sectional view of a portion of the liquid discharge head of FIG. 2. FIG. 4 is a cross-sectional view of a portion of the liquid discharge head of FIG. 2 cut along the nozzle array direction.

A liquid discharge head 404 according to the present embodiment includes a nozzle plate 1, a channel plate 2, a diaphragm plate 3, piezoelectric elements 11 as pressure generating elements (pressure generators), a holding substrate 50, a wire 60, and a frame substrate 70 also serving as a common-liquid-chamber substrate.

The channel plate 2, the diaphragm plate 3, and the piezoelectric element 11 form an actuator substrate 20 according to the present embodiment. Note that the actuator substrate 20 does not include the nozzle plate 1 or the holding substrate 50 that is bonded to the actuator substrate 20 after the actuator substrate 20 is formed as an independent component.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid inlets (passages) 8 communicated with the fluid restrictors 7.

The liquid inlets 8 are communicated with the common liquid chambers 10 in the frame substrate 70 via passages (supply ports) 9 of the diaphragm plate 3 and openings 51 as channels of the holding substrate 50.

The diaphragm plate 3 forms a deformable vibration portion 30 forming part of a wall of the individual liquid chamber 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is disposed on the piezoelectric element 11.

The lower electrode 13 as a common electrode for the plurality of piezoelectric elements 11 is connected to a common-electrode power-supply wiring pattern 121 via a common wire 15. Note that, as illustrated in FIG. 4, the lower electrode 13 is a single electrode layer straddling all of the piezoelectric elements 11 in the nozzle array direction indicated by arrow NAD in FIG. 4.

The upper electrodes 14 as discrete electrodes for the piezoelectric elements 11 are connected to a drive integrated circuit (IC) 500 (hereinafter, driver IC 500) as a drive circuit via individual wires 16. The individual wires 16 are covered with insulation films 22.

The driver IC 500 are mounted on the actuator substrate 20 by, e.g., a flip-chip bonding method, to cover an area between rows of the piezoelectric elements 11.

The driver IC 500 mounted on the actuator substrate 20 is connected to a discrete-electrode power-supply wiring pattern 101 to which a drive waveform (drive signal) is supplied.

One end of the wire 60 is electrically connected to the driver IC 500. The opposite end of the wire 60 is connected to a controller mounted to an apparatus body.

The openings 51 as channels communicating the common liquid chambers 10 with the individual liquid chambers 6 as described above, recessed portions 52 to accommodate the piezoelectric elements 11, and the holding substrate 50 including openings 53 to accommodate the driver ICs 500 are disposed on the actuator substrates 20.

The holding substrate 50 is bonded to a side of the actuator substrate 20 facing the diaphragm plate 3 with adhesive.

The frame substrate 70 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71 (see FIG. 1).

A damper unit 90 is bonded to the frame substrate 70. The damper unit 90 includes a damper 91 and damper plates 92. The damper 91 is deformable and forms part of walls of the common liquid chambers 10. The damper plates 92 reinforce the damper 91.

The frame substrate 70 is bonded to an outer peripheral portion of the nozzle plate 1, to accommodate the actuator substrate 20 and the holding substrate 50, thus forming a frame of the liquid discharge heads 404.

Nozzle covers 45 are disposed to cover part of a peripheral area of the nozzle plate 1 and part of outer circumferential faces of the frame substrate 70.

In the liquid discharge head 404, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30.

At this time, since a side (hereinafter, lower electrode 13 side) of the piezoelectric layer 12 facing the vibration portion 30 is bound by the vibration portion 30, a tensile stress arises at the lower electrode 13 side of the vibration portion 30, thus causing the vibration portion 30 to bend toward a side (hereinafter, individual liquid chamber 6 side) of the vibration portion 30 facing the individual liquid chamber 6. Accordingly, liquid within the individual liquid chamber 6 is pressurized and discharged from the nozzle 4.

Figure 5:
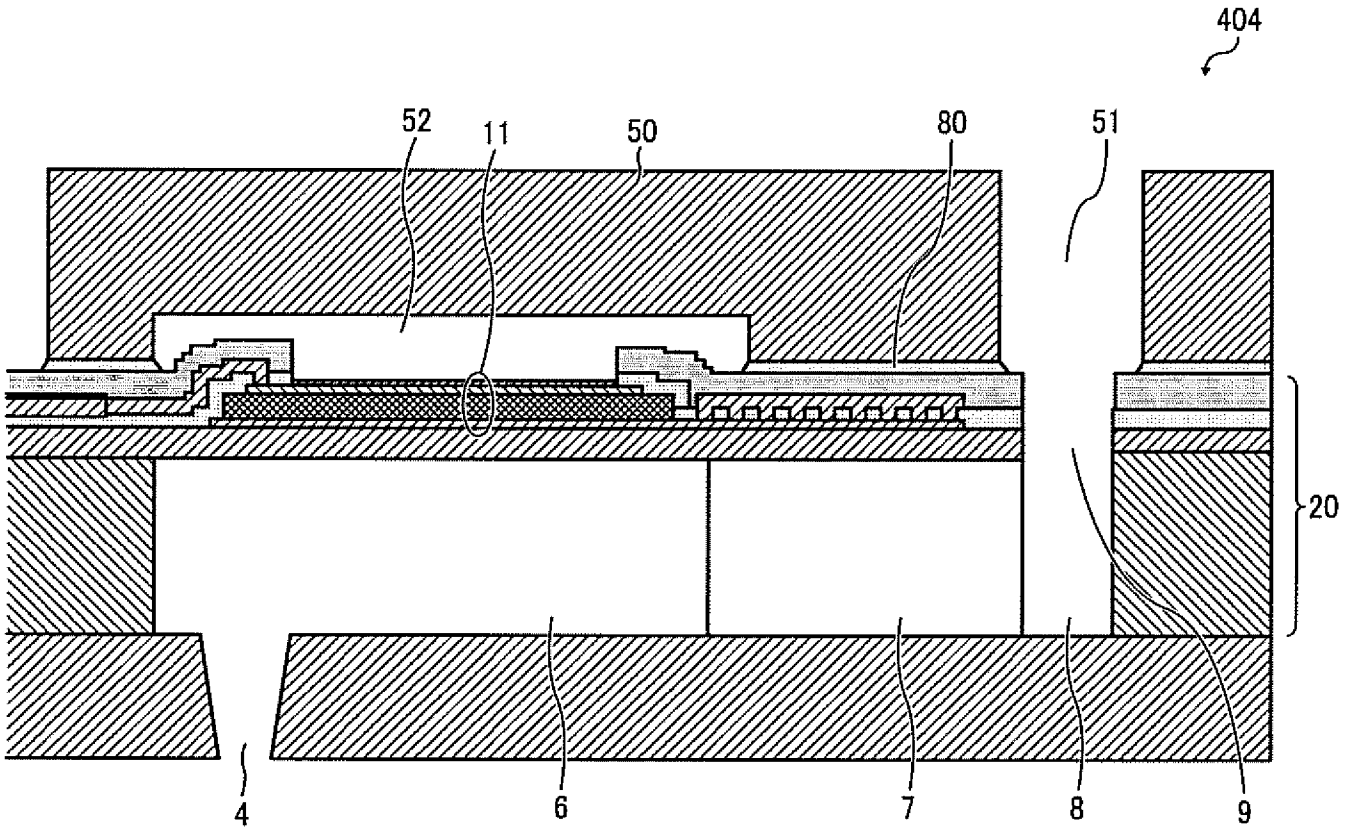
FIG. 5 is an enlarged cross-sectional view of an opening portion of a holding substrate according to the first embodiment, cut along a direction perpendicular to the nozzle array direction.
Figure 6:
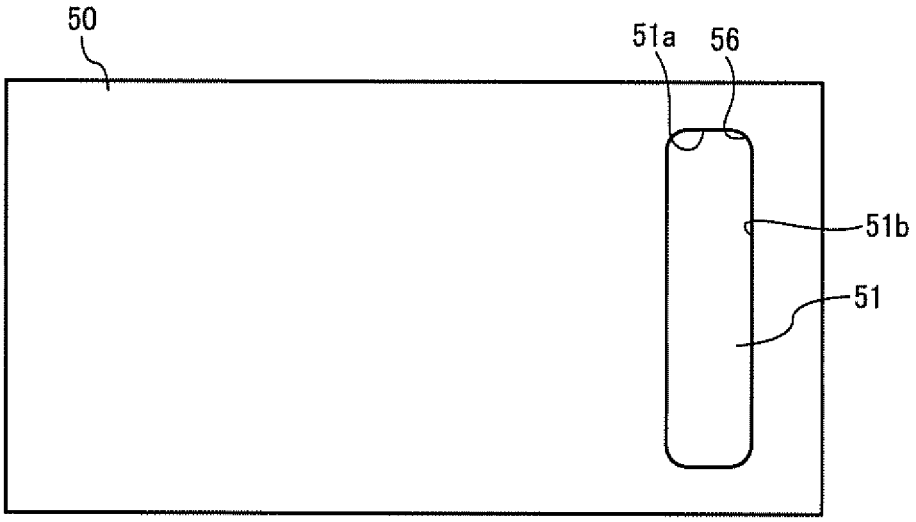
FIG. 6 is a plan view of an opening portion of the holding substrate of FIG. 5.
Figure 7:
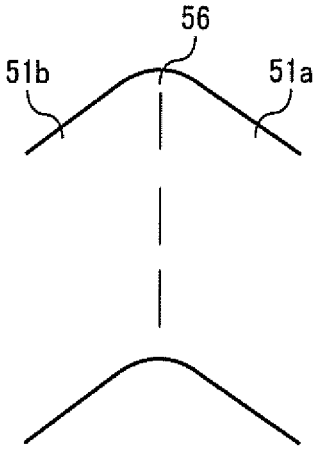
FIG. 7 is a perspective view of a corner of an opening of the holding substrate of FIG. 5.

Next, a first embodiment of the present disclosure is described with reference to FIGS. 5 through 7. FIG. 5 is an enlarged cross-sectional view of an opening portion of the holding substrate according to the first embodiment, cut along a direction perpendicular to the nozzle array direction. FIG. 6 is a plan view of the opening portion of the holding substrate of FIG. 5. FIG. 7 is a perspective view of a corner of an opening of the holding substrate.

The holding substrate 50 has the opening 51 as the channel communicating the common liquid chamber 10 with the individual liquid chamber 6. The opening 51 has a length corresponding to the plurality of individual liquid chambers 6 in the nozzle array direction and a substantially rectangular shape in the plan view. Note that, in the present embodiment, the opening 51 of the holding substrate 50 is larger than the supply port 9 of the actuator substrate 20. In some embodiments, as illustrated in FIG. 2, the opening 51 of the holding substrate 50 has the same size as the supply port 9 of the actuator substrate 20.

In the present embodiment, as illustrated in FIGS. 6 and 7, four corners 56 formed by short-side walls 51*a* and long-side walls 51*b* of the opening 51 of the holding substrate 50 have curved surfaces.

In such a case, each of the corners 56 have a curved surface across the entire range from a bonded surface with the actuator substrate 20 to a bonded surface with the frame substrate 70.

Figure 8:
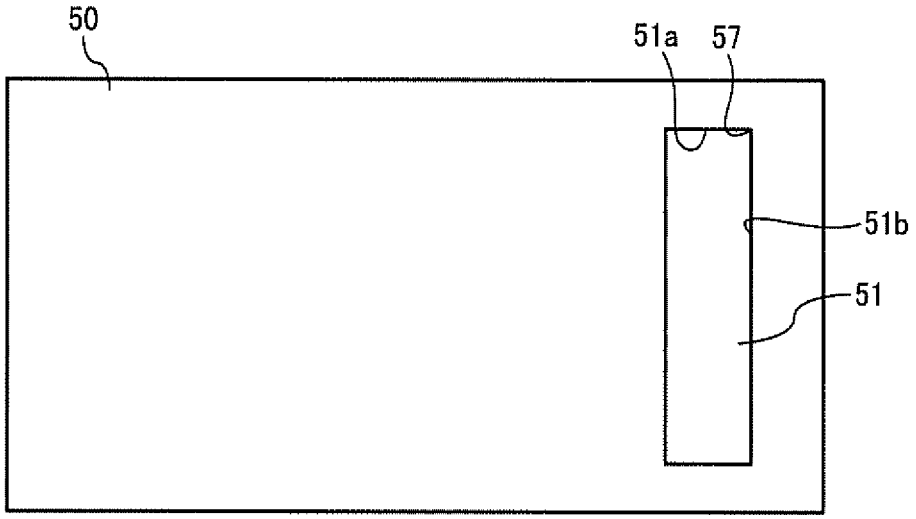
FIG. 8 is a plan view of a comparative example of the holding substrate.
Figure 9:
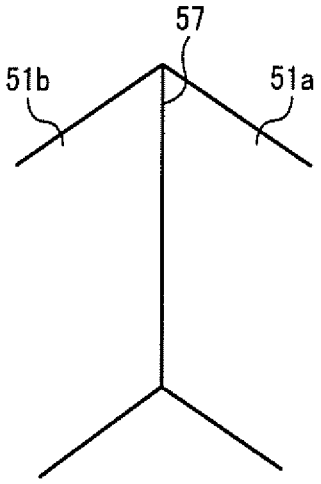
FIG. 9 is a perspective view of a corner of an opening of the comparative example of the holding substrate.

Below, a comparative example is described with reference to FIGS. 8 and 9. FIG. 8 is a plan view of a comparative example of the holding substrate. FIG. 9 is a perspective view of a corner of an opening of the comparative example of the holding substrate.

For the comparative example, four corners 57 of the opening 51 of the holding substrate 50 have a right angle shape. A short-side wall 51*a* and a long-side wall 51*b* cross each other at right angles.

Next, a description is given of operation of the present embodiment.

As illustrated in FIG. 5, when the holding substrate 50 is bonded to the actuator substrate 20 with an adhesive 80, the adhesive 80 may extend off a bonded portion toward the opening 51.

In such a case, as in the comparative example illustrated in FIGS. 8 and 9, the corners 57 of the opening 51 have the right angle shape, a capillary action due to surface tension arise at the corners 57. Accordingly, for the comparative example, the adhesive 80 extended off the bonded portion may move along the corners 57 of the opening 51 to a bonded surface of the holding substrate 50 with the frame substrate 70 (a surface opposite a bonded surface with the actuator substrate 20), and flow out from the opening 51 onto the bonded surface with the frame substrate 70.

Hence, as in the present embodiment, the curved surface of the corners 56 of the opening 51 can reduce such a capillary action due to the surface tension. Such a configuration can prevent the adhesive 80 extended off the bonded portion from moving onto the bonded surface with the frame substrate 70 and flowing out from the opening 51 onto the bonded surface with the frame substrate 70.

Such a configuration can also prevent the occurrence of foreign substances and a reduction in reliability of a bonding interface between the holding substrate 50 and the frame substrate 70.

Note that, in the present embodiment, all of the four corners 56 have curved surfaces. In some embodiments, only a corner(s) at which the amount of adhesive extended off the bonded portion is relatively large may have a curved surface.

Figure 10:
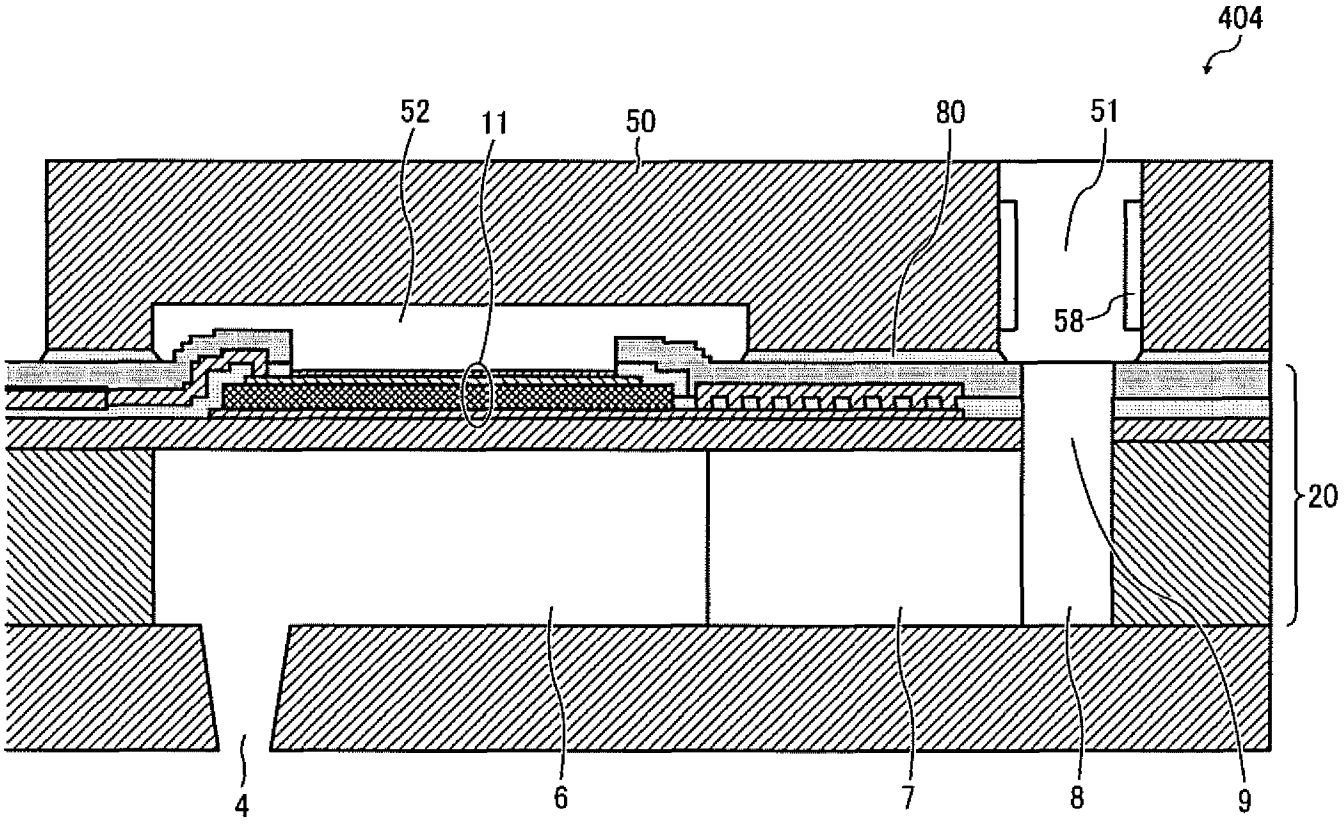
FIG. 10 is an enlarged cross-sectional view of an opening portion of the holding substrate according to the second embodiment, cut along the direction perpendicular to the nozzle array direction.
Figure 11:
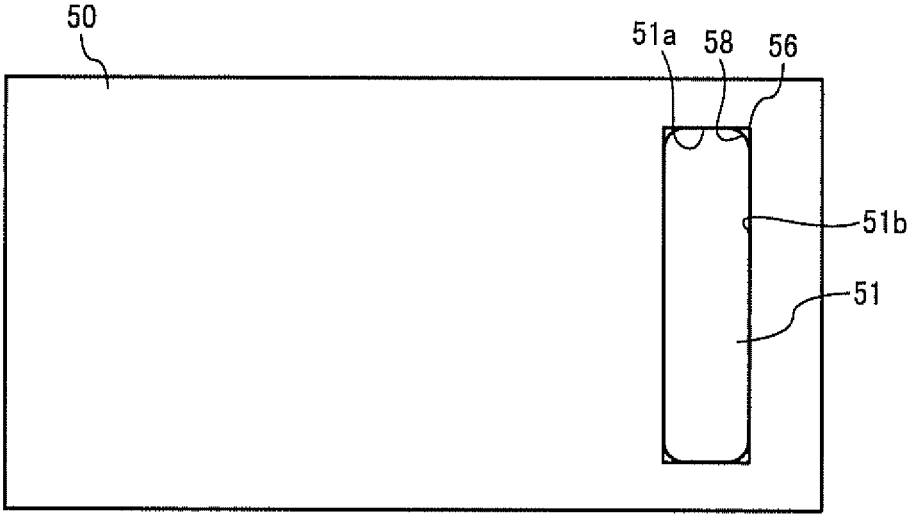
FIG. 11 is a plan view of the opening portion of the holding substrate of FIG. 10.
Figure 12:
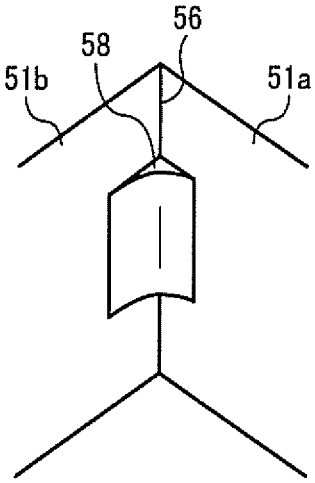
FIG. 12 is a perspective view of a corner of an opening of the holding substrate of FIG. 10.

Next, a second embodiment of the present disclosure is described with reference to FIGS. 10 to 12. FIG. 10 is an enlarged cross-sectional view of the opening portion of the holding substrate according to the second embodiment, cut along the direction perpendicular to the nozzle array direction. FIG. 11 is a plan view of the opening portion of the holding substrate of FIG. 10. FIG. 12 is a perspective view of a corner of an opening of the holding substrate.

For the second embodiment, a curved surface portion 58 is disposed on a portion of the corner 56 between the bonded surface with the actuator substrate 20 and the bonded surface with the frame substrate 70.

With such a configuration, the curved surface portion 58 can reduce capillary action, thus preventing adhesive from flowing off the curved surface portion 58 to the bonded surface with the frame substrate 70.

Figure 13:
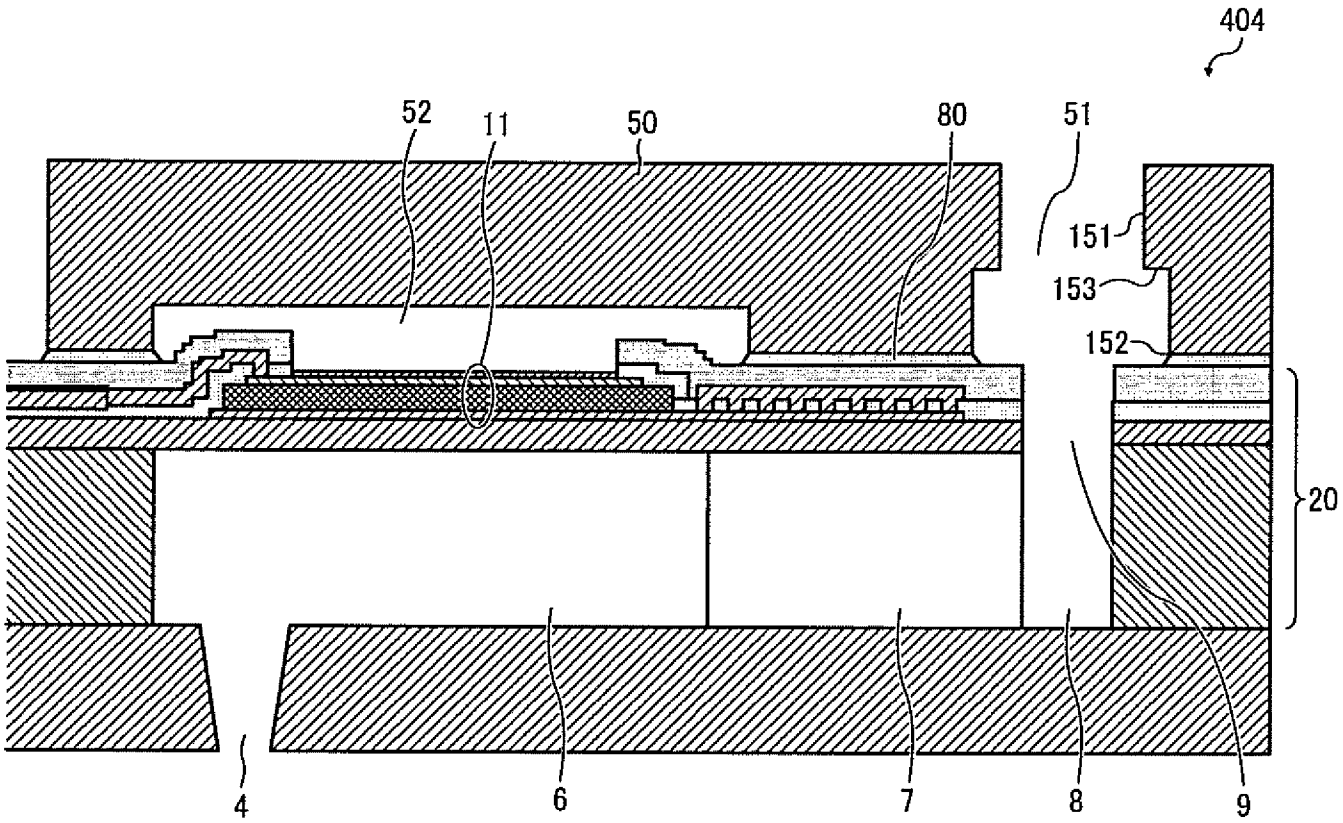
FIG. 13 is an enlarged cross-sectional view of the opening portion of the holding substrate according to the third embodiment, cut along the direction perpendicular to the nozzle array direction.
Figure 14:
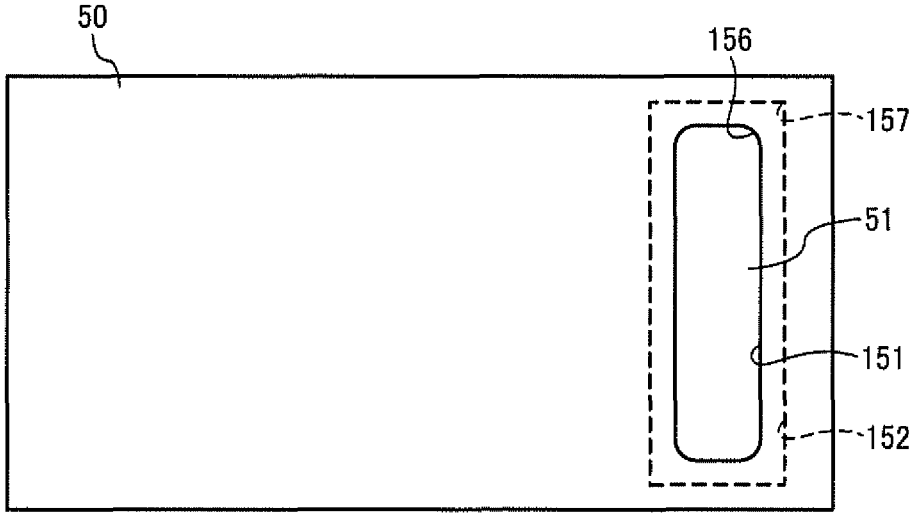
FIG. 14 is a plan view of the opening portion of the holding substrate of FIG. 13.

Next, a third embodiment of the present disclosure is described with reference to FIGS. 13 and 14. FIG. 13 is an enlarged cross-sectional view of the opening portion of the holding substrate according to the third embodiment, cut along the direction perpendicular to the nozzle array direction. FIG. 14 is a plan view of the opening portion of the holding substrate of FIG. 13.

In the third embodiment, the opening 51 of the holding substrate 50 includes a first opening portion 151 closer to the common liquid chamber 10 and a second opening portion 152 closer to the individual liquid chamber 6 (the actuator substrate 20). The opening area of the first opening portion 151 is smaller than the opening area of the second opening portion 152 and has a step 153 between the first opening portion 151 and the second opening portion 152.

Corners 156 of the first opening portion 151 have curved surfaces as in the above-described first embodiment. Corners 157 of the second opening portion 152 have a right angle shape.

In the third embodiment, since the corners 157 of the second opening portion 152 have a right angle shape, the adhesive 80 extended off a bonded portion between the holding substrate 50 and the actuator substrate 20 flows toward the first opening portion 151 by capillary action and accumulates at the step 153.

Such a configuration reduces the flow of the adhesive 80 moving along the second opening portion 152 toward the first opening portion 151.

When the adhesive 80 flows toward the first opening portion 151 over the step 153, the curved surfaces of the corners 156 of the first opening portion 151 reduces the occurrence of capillary phenomenon.

Such a configuration reduces the flow of the adhesive 80 from the corners 156 of the first opening portion 151 toward the bonded surface with the frame substrate 70, thus reducing the outflow of the adhesive 80 toward the bonded surface with the frame substrate 70.

Figure 15:
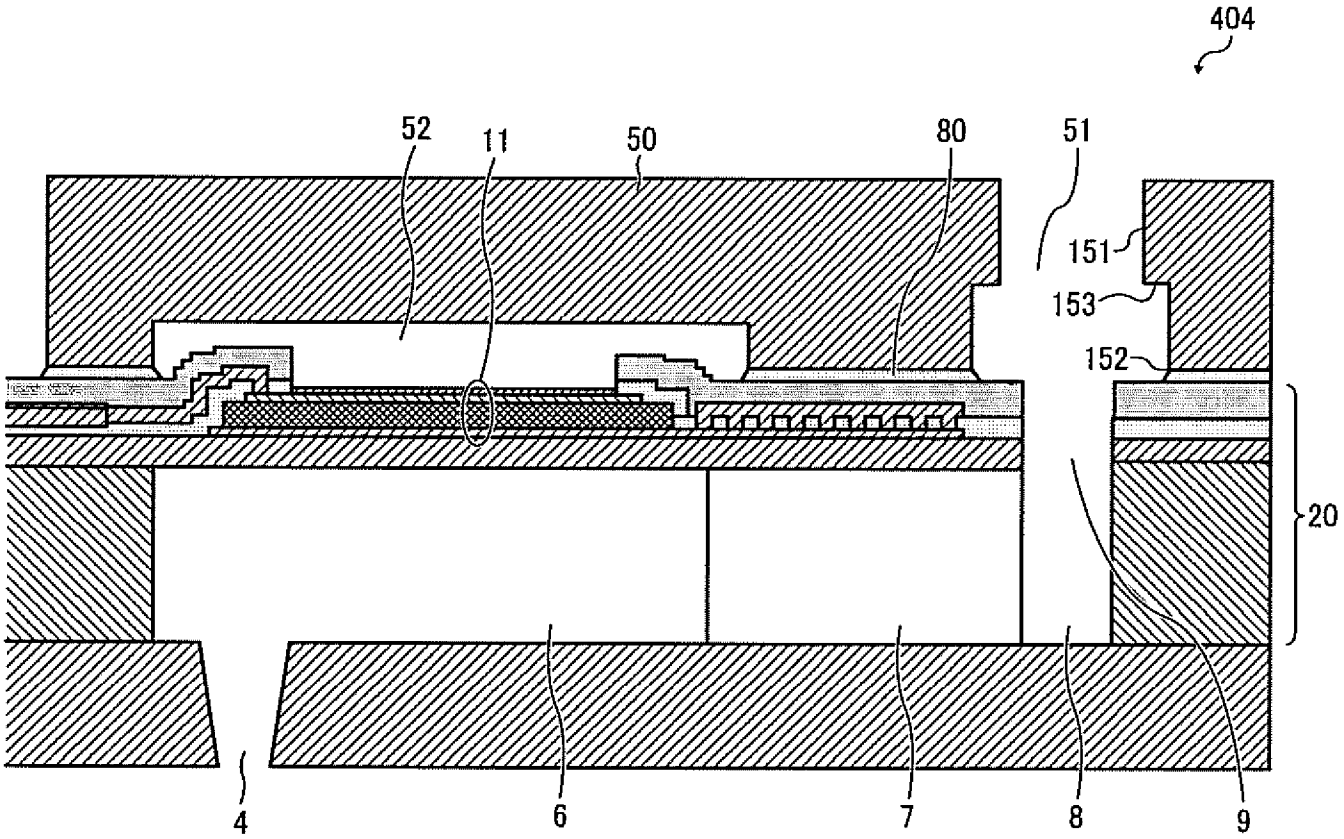
FIG. 15 is an enlarged cross-sectional view of the opening portion of the holding substrate according to the fourth embodiment, cut along the direction perpendicular to the nozzle array direction.
Figure 16:
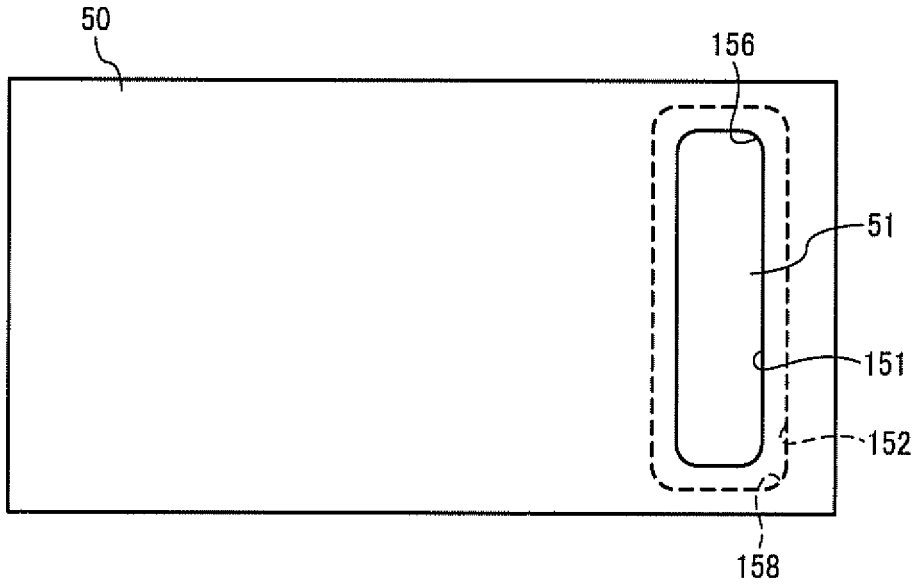
FIG. 16 is a plan view of the opening portion of the holding substrate of FIG. 15.

Next, a fourth embodiment of the present disclosure is described with reference to FIGS. 15 and 16. FIG. 15 is an enlarged cross-sectional view of the opening portion of the holding substrate according to the fourth embodiment, cut along the direction perpendicular to the nozzle array direction. FIG. 16 is a plan view of the opening portion of the holding substrate of FIG. 15.

In the fourth embodiment, corners 158 of the second opening portion 152 according to the above-described third embodiment also have curved surfaces.

Such a configuration more reliably reduces the flow of the adhesive 80 from the corners 156 of the first opening portion 151 toward the bonded surface with the frame substrate 70 without increasing the size of the step 153.

Next, the curved surface of the corner of the opening portion is described with reference to FIGS. 17 and 18.

The opening 51 of the holding substrate 50 has a shape having no step as in the above-described first embodiment. As illustrated in FIG. 17, the outflow of the adhesive toward the bonded surface with the frame substrate 70 was evaluated when the corner 56 has an arc shape of a radius R of 25 μm, 60 μm, or 40 μm with the width (opening width) L of the opening 51 in the direction perpendicular to the nozzle array direction NAD being 250 μm.

Likewise, the outflow of the adhesive toward the bonded surface with the frame substrate 70 was evaluated when the corner 56 has an arc shape of a radius R of 100 μm or 20 μm with the opening width L of the opening 51 in the direction perpendicular to the nozzle array direction NAD being 200 μm. Likewise, the outflow of the adhesive toward the bonded surface with the frame substrate 70 was evaluated when the corner 56 has an arc shape of a radius R of 80 μm or 20 μm with the opening width L of the opening 51 in the direction perpendicular to the nozzle array direction NAD being 160 μm.

Evaluation results are illustrated in FIG. 17.

From the results of FIG. 17, the curved surface of the corner 56 of the opening 51 preferably has an arc shape of a radius of from 6/25 to ½ of the width (opening width) of the opening 51 in the direction perpendicular to the nozzle array direction NAD with respect to the prevention of the outflow.

Next, as illustrated in FIG. 18, the outflow of the adhesive toward the bonded surface with the frame substrate 70 was evaluated for different combinations of the radius R of an arc shape and the presence-and-absence of the step 153 of the opening 51, with the opening width L of each of the opening 51 (without step) and the first opening portion 151 (with step) being 250 μm.

Evaluation results are illustrated in FIG. 18. Note that, in FIG. 18, the opening 51 and the first opening portion 151 are referred to as "opening".

As illustrated in FIG. 18, when the radius R is 40 μm, the outflow of the adhesive occurs in the configuration of the first embodiment without the step 153. For the configuration with the step 153, the outflow of the adhesive does not occur.

From the results of FIG. 18 and FIG. 17, the curved surface of the corner 156 of the first opening portion 151 preferably has an arc shape of a radius of from 4/25 to ½ of the width (opening width) of the first opening portion 151 in the direction perpendicular to the nozzle array direction NAD with respect to the prevention of the outflow.

As described above, providing the step 153 can reduce the outflow of the adhesive even with a reduced radius R.

Figure 19:
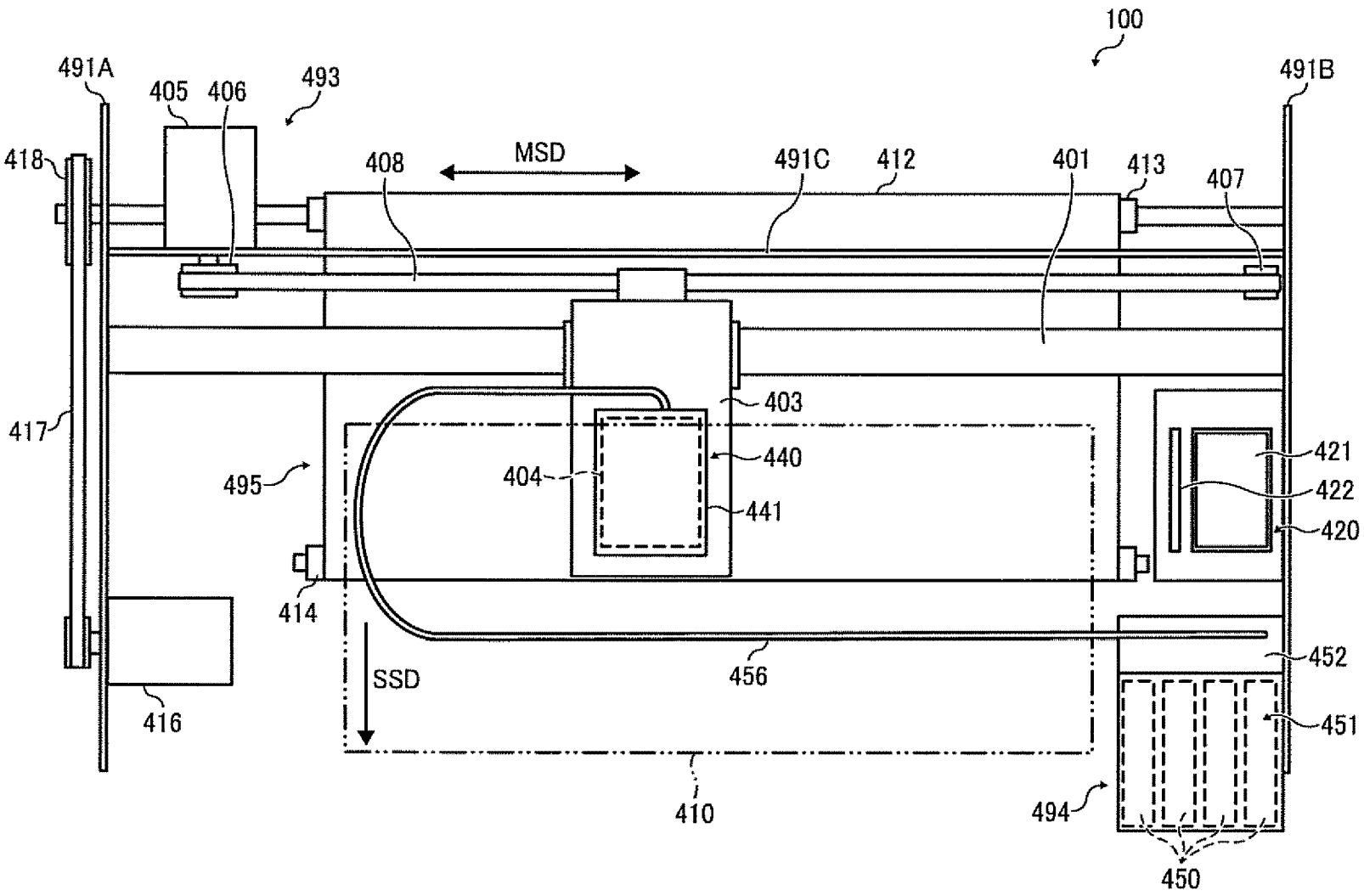
FIG. 19 is a plan view of a portion of a liquid discharge apparatus according to an embodiment of the present disclosure.
Figure 20:
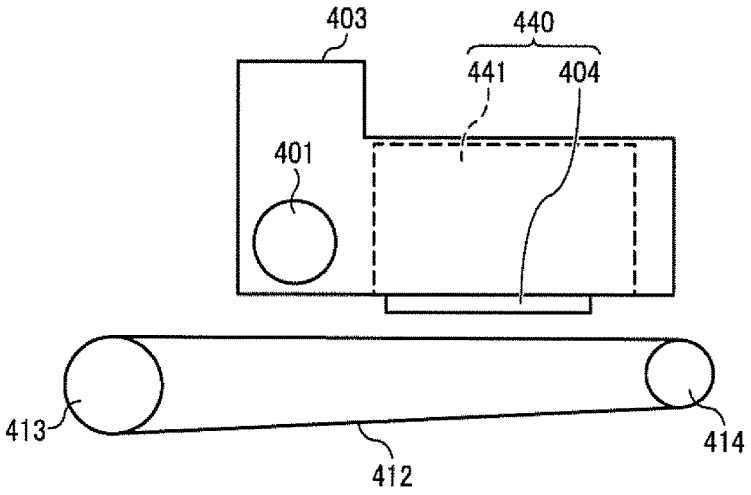
FIG. 20 is a side view of a portion of the liquid discharge apparatus of FIG. 19 including a liquid discharge device.

Next, a liquid discharge apparatus according to an embodiment of the present disclosure is described with reference to FIGS. 19 and 20. FIG. 19 is a plan view of a portion of the liquid discharge apparatus according to an embodiment of the present disclosure. FIG. 20 is a side view of a portion of the liquid discharge apparatus of FIG. 19.

A liquid discharge apparatus 100 according to the present embodiment is a serial-type apparatus in which a main scan moving unit 493 reciprocally moves a carriage 403 in a main scanning direction indicated by arrow MSD in FIG. 19. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 19, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridges 450 are detachably mounted to the cartridge holder 451. The liquid is supplied to the head tank 441 by the liquid feed unit 452 via the tube 456 from the liquid cartridges 450.

The liquid discharge apparatus 100 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 100 includes the liquid discharge head 404 according to an embodiment of the present disclosure, thus allowing stable formation of high quality images.

Figure 21:
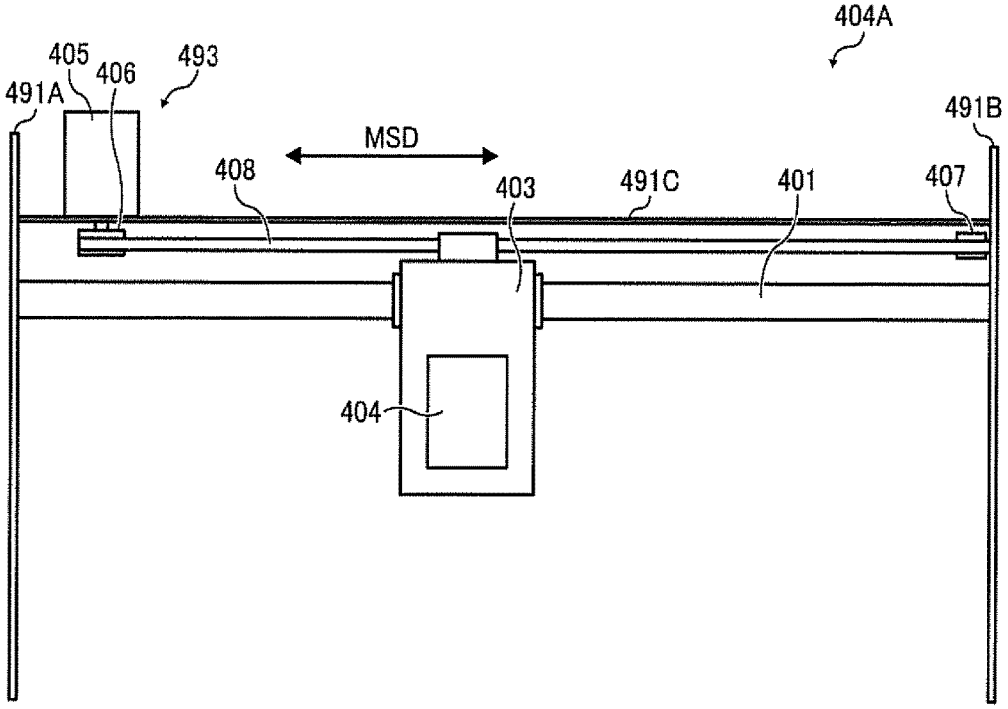
FIG. 21 is a plan view of a portion of another example of the liquid discharge device.

Next, another example of the liquid discharge device according to an embodiment of the present disclosure is described with reference to FIG. 21. FIG. 21 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 100. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 22:
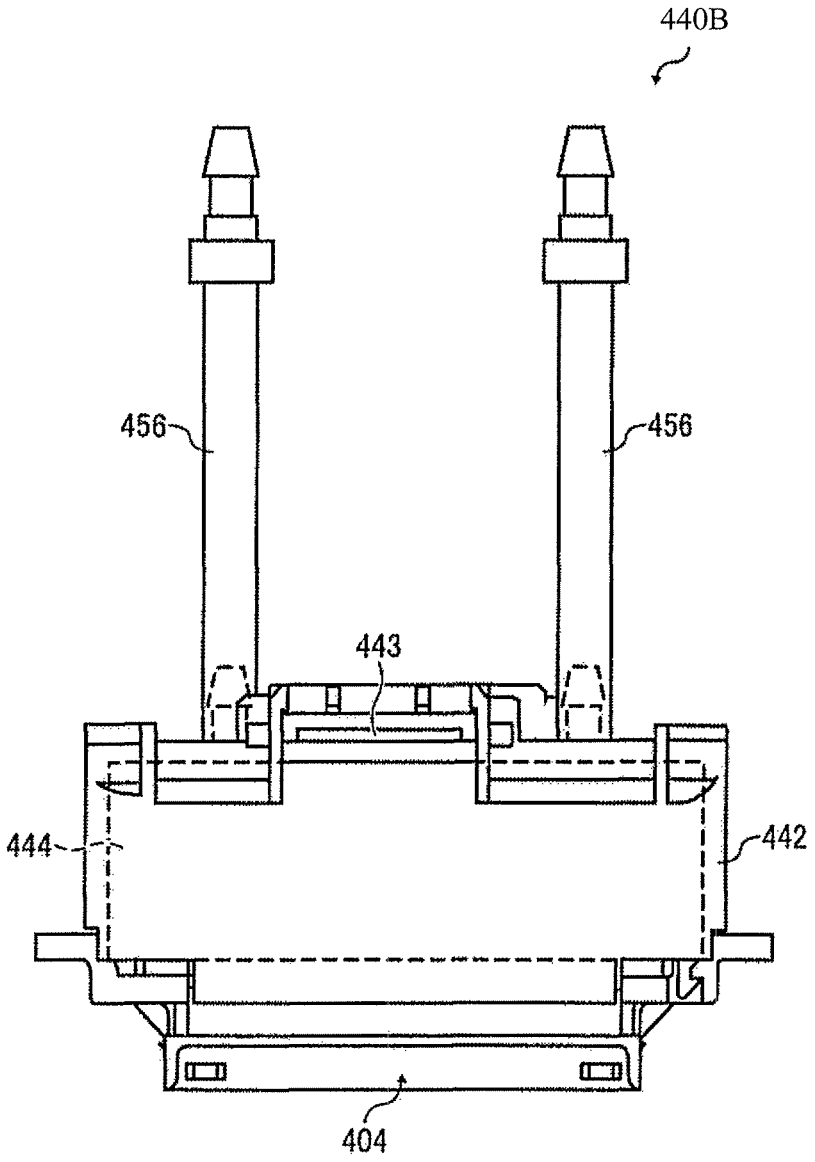
FIG. 22 is a front view of still another example of the liquid discharge device.

Next, still another example of the liquid discharge device according to an embodiment of the present disclosure is described with reference to FIG. 22. FIG. 22 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, and ceramics, to which liquid can adhere even temporarily.

The liquid may be, e.g., ink, treatment liquid, DNA sample, resist, pattern material, binder, and mold liquid.

The liquid discharge apparatus may be, unless in particular limited, any of a serial-type apparatus to move the liquid discharge head and a line-type apparatus not to move the liquid discharge head.

The liquid discharge apparatus may be, for example, a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may be, for example, a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 20. The liquid discharge head and the head tank may be connected each other via, e.g., a tube to form the liquid discharge device as the integrated unit. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by the guide that forms part of the main scan moving unit, so that the liquid discharge head and the main scan moving unit are integrated as a single unit. Like the liquid discharge device 440A illustrated in FIG. 21, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 22, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a common liquid chamber; and an actuator substrate including:

a plurality of individual liquid chambers communicated with a plurality of nozzles, respectively, to discharge liquid; and a plurality of pressure generating elements (a) arranged in a nozzle array direction in which the plurality of nozzles are arrayed in row and (b) arrayed to pressurize liquid in the plurality of individual liquid chambers, respectively; and a holding substrate bonded to the actuator substrate with an adhesive, to hold the actuator substrate, the holding substrate having a through-hole penetrating through the holding substrate, to communicate the common liquid chamber with the plurality of individual liquid chambers via respective liquid inlets, wherein the through-hole has an elongated shape extending in the nozzle array direction, the elongated shape including four corners and having a length in the nozzle array direction corresponding to the plurality of individual liquid chambers in plan view, and each of the four corners of the elongated shape of the through-hole, at which inner wall surfaces of the through-hole along a thickness direction of the holding substrate merge each other, has at least partially a curved surface, and wherein the adhesive extends to the through-hole, and the through-hole of the elongated shape including the four curved-surface corners and having the length in the nozzle array direction corresponding to the plurality of individual liquid chambers in plan view is configured and disposed to reduce capillary action on the adhesive bonding the holding substrate with the actuator substrate in which the plurality of pressure generating elements are disposed to pressurize the liquid in the respective individual liquid chambers.

2. The liquid discharge head according to claim 1, wherein the curved surface of the at least one corner of the through-hole has an arc shape of a radius of from 6/25 to ½ of a width of the through-hole in a direction perpendicular to the nozzle array direction.

3. The liquid discharge head according to claim 1, wherein the through-hole includes:

a first through-hole portion at a side closer to a common liquid chamber to supply liquid to the plurality of individual liquid chambers;

a second through-hole portion at a side closer to the plurality of individual liquid chambers; and a step between the first through-hole portion and the second through-hole portion, wherein the first through-hole portion has a smaller opening area than an opening area of the second through-hole portion, and wherein at least one corner of the first through-hole portion at least partially has a curved surface.

4. The liquid discharge head according to claim 3, wherein the curved surface of the at least one corner of the first through-hole portion has an arc shape of a radius of from 4/25 to ½ of a width of the through-hole in a direction perpendicular to the nozzle array direction.

5. The liquid discharge head according to claim 3, wherein at least one corner of the second through-hole at least partially has a curved surface.

6. A liquid discharge device comprising the liquid discharge head according to claim 1 to discharge liquid.

7. The liquid discharge device according to claim 6, wherein the liquid discharge head is integrated as a single unit with at least one of:

a head tank to store liquid to be supplied to the liquid discharge head;

a carriage mounting the liquid discharge head;

a supply unit to supply liquid to the liquid discharge head;

a maintenance unit to maintain and recover the liquid discharge head; and a main scan moving unit to move the liquid discharge head in a main scanning direction.

8. A liquid discharge apparatus comprising the liquid discharge device according to claim 6 to discharge liquid.

9. A liquid discharge apparatus comprising the liquid discharge head according to claim 1 to discharge liquid.

* * * * *